United States Patent [19]

Bondarchuk, Sr.

[11] 4,047,257

[45] Sept. 13, 1977

[54] LIFE SAVING APPARATUS

[75] Inventor: Walter W. Bondarchuk, Sr., Greenport, N.Y.

[73] Assignee: Lawrence Peska Assoc., Inc., New York, N.Y.

[21] Appl. No.: 688,604

[22] Filed: May 21, 1976

[51] Int. Cl.[2] ..... E01D 15/14

[52] U.S. Cl. ..... 14/27; 404/35; 61/48

[58] Field of Search ..... 404/35; 14/27; 61/48

[56] References Cited

U.S. PATENT DOCUMENTS

| | | | |
|---|---|---|---|
| 146,426 | 1/1874 | Borgfeldt | 14/27 X |
| 175,019 | 3/1876 | Borgfeldt | 14/27 X |
| 3,252,173 | 5/1966 | Robinsky | 14/27 |
| 3,466,685 | 9/1969 | Robinsky | 14/27 |
| 3,496,586 | 2/1970 | Kaufman | 14/27 |

*Primary Examiner*—Nile C. Byers

[57] ABSTRACT

A lifesaving apparatus for use, for example, in rescuing a person who has fallen through the ice, includes a series of slats, flexibly connected to one another, forming a long flexible mat. One end of the mat is provided with an anchoring device, used to fix the end of the mat to the shore. The other end is provided with a flotation device, which may also serve as a core on which to roll the mat. The slats serve to spread the weight of the rescuer over the ice and the entire mat serves as a path to lead the endangered person to safety.

4 Claims, 5 Drawing Figures

LIFE SAVING APPARATUS

BACKGROUND OF THE INVENTION

The invention is in the field of life saving devices, particularly, portable devices, easily moved from place to place as needed. The inventive device is particularly useful for rescuing persons who have fallen through the ice of a pond or lake. In such emergency situations a number of improvised devices are commonly used, such as ladders, ropes or "human chains". However, they all have drawbacks. Ladders are too short, in most situations, to provide adequate safety for the rescuer. The "human chain" also places the rescuers in significant danger. The use of a simple rope is usually not adequate, because of the weakened condition of the endangered person.

SUMMARY OF THE INVENTION

The inventive life saving device includes an elongated flexible mat, which can be fixed on the shore and rolled out over the ice to the fallen person. This provides a safe path for the rescuer and the rescued person. The mat is provided with an anchoring device at one end and a flotation device at the other, which may also serve as a core to aid in rolling the device. The floatation core can also be used to aid in lifting the fallen person out of the water to safety.

DETAILED DESCRIPTION OF THE INVENTION

Figure 1:
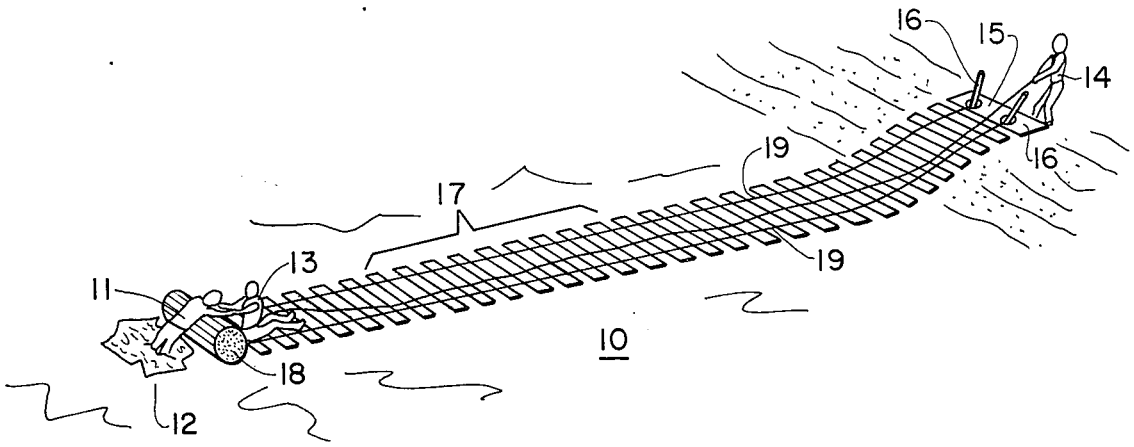
FIG. 1 is a perspective view of an exemplary rescue operation using a device of the invention.

The inventive device is illustrated in operation in FIG. 1. A skater 11 has fallen through the ice 12. The inventive rescue device 10 has been carried to the nearest point on the shore by the rescuers 13, 14. The anchor end 15 has been fixed to the shore by, for example, driving stakes 16 through holes in the anchor end 15. A rescuer 13 has crawled out over the elongated mat 17 in order to help the fallen skater "out of the water". The flotation core 18, together with the rolled remainder of the mat 17 is being used to help lift the skater 11 onto the mat 17. This is done by having the skater 11 grasp the mat and having the rescuers 13 roll the core 18 toward the shore. This gives a combined upward and shoreward thrust to the skater 11. Once the skater 11 is on the mat 17, both rescuer 13 and skater 11 can crawl on the mat 17 to safety. Even if the ice 12 breaks under the mat 17, the mat 17 provides a safe path fixed to the shore.

A preferred form for the mat is a series of rigid flexibly connected slats, such as is commonly called "snow fence". The rigid slats serve to spread the weight of the rescuer out over a larger portion of the ice and provide a light weight, flexible, easily carried device. The flexible connection can be provided, for example, by wire or cord 19 interwoven between the slats.

Figure 2:
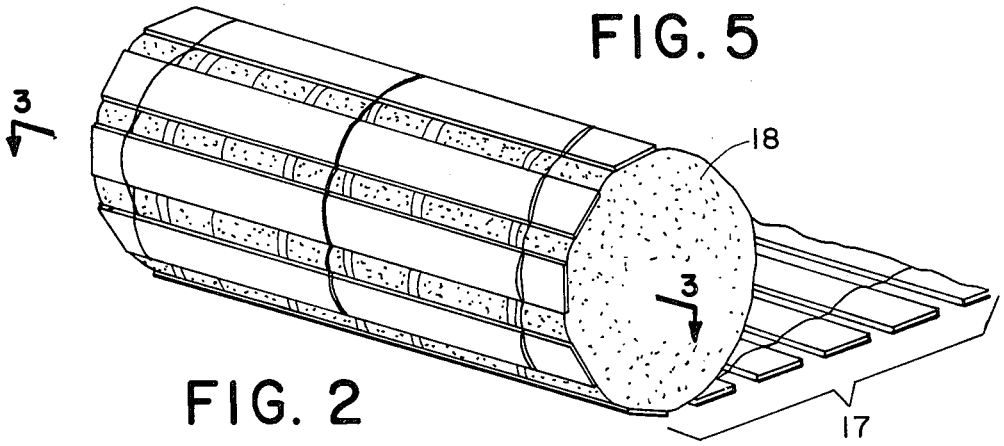
FIG. 2 is a perspective view of the floatation end of an exemplary device of the invention.

FIG. 2 shows the end of the mat affixed to a flotation device 18 parallel to the slats. The flotation device 18 serves to support the end of the mat 17 if, for example, the ice breaks and the end falls into the water. The device 18 may also serve as a core for rolling up the mat 17 for convenient storage and transportation. A particularly advantageous material for use as a flotation device 18 is a rigid foamed polymer, such as a polystyrene foam.

Figure 3:
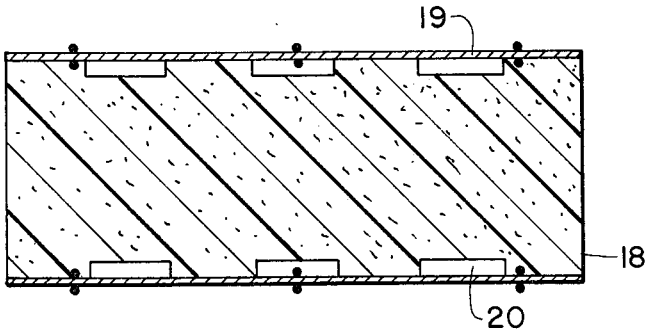
FIG. 3 is an elevational view in section of the flotation end of an examplary device of the invention.

FIG. 3 is a cross section of a flotation core 18 illustrating the presence of annular grooves 20 in the core. These depressions serve as a hand hold, allowing the user to reach between the slats and grasp the device.

Figure 5:
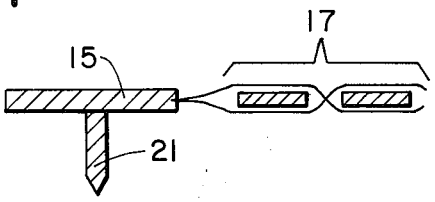
FIG. 5 is an elevational view of the anchor end of an exemplary device of the invention.
Figure 4:
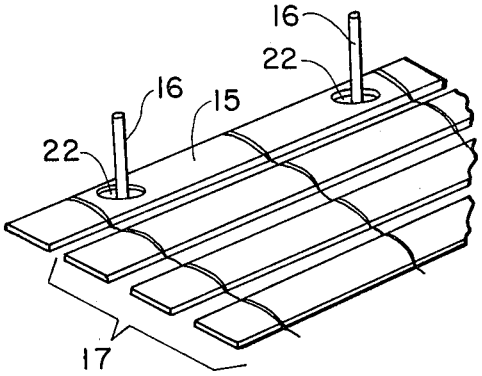
FIG. 4 is a perspective view of the anchor end of an exemplary device of the invention.

FIG. 4 shows the anchored end of an exemplary device of the invention. The mat 17 is affixed to an anchoring device 15, which may, for example, be a member provided with holes 22. The holes are provided to allow anchoring stakes 16 to be driven into the shore. Another exemplary anchoring device 15 (FIG. 5) is provided with anchoring spikes 21, which may be quickly driven into the ground by stamping on the device 15.

What is claimed is:

1. A life saving device comprising a flexible elongated mat, which mat includes a plurality of rigid slats extending crosswise of the mat, each slat being affixed to the adjacent slats by means of at least one flexible member, which mat is terminated at its first end by a flotational member and at its second end by an anchoring member, the flotational member including a cylinder of rigid foamed polymer affixed to the mat in an orientation parallel to the slats.

2. A device of claim 1 in which the slats consist essentially of wood.

3. A device of claim 2 in which the flexible member is wire.

4. A device of claim 1 in which the cylinder is provided with annular grooves whereby finger grips are provided for the convenience of the user.

* * * * *